US012788131B1

(12) United States Patent
Jobe et al.

(10) Patent No.: US 12,788,131 B1
(45) Date of Patent: Nov. 10, 2026

(54) RUN RIPPER RUNNER'S APPARATUS

(71) Applicants: Karen E. Jobe, Galveston, TX (US); James Shae Jobe, Galveston, TX (US)

(72) Inventors: Karen E. Jobe, Galveston, TX (US); James Shae Jobe, Galveston, TX (US)

( * ) Notice: Subject to any disclaimer, the term of this patent is extended or adjusted under 35 U.S.C. 154(b) by 33 days.

(21) Appl. No.: 19/005,479

(22) Filed: Dec. 30, 2024

Related U.S. Application Data

(60) Provisional application No. 63/727,653, filed on Dec. 3, 2024.

(51) Int. Cl.
*A45F 5/02* (2006.01)
*A45F 5/00* (2006.01)

(52) U.S. Cl.
CPC ..... *A45F 5/021* (2013.01); *A45F 5/1583* (2025.01)

(58) Field of Classification Search
CPC ..... A45F 5/021; A45F 5/1583; A45F 3/14
See application file for complete search history.

(56) References Cited

U.S. PATENT DOCUMENTS 1,725,700 A * 8/1929 Cody ..... F16B 21/12 411/514
3,128,514 A * 4/1964 Parker ..... A44B 18/00 24/3.9
5,140,723 A 8/1992 Genzel
8,397,962 B1 3/2013 O'Connell
9,212,067 B2 12/2015 Gellibolian
10,285,523 B2 5/2019 Pugsley
12,396,545 B2 * 8/2025 Wagner, II ..... A45F 3/005
2004/0206796 A1 * 10/2004 Badillo ..... G03B 17/561 224/675
2005/0263552 A1 * 12/2005 Panosian ..... A45F 5/02 224/904
2007/0293288 A1 * 12/2007 Lin ..... H04M 1/04 455/575.8
2011/0259891 A1 * 10/2011 Thibault ..... B44D 3/14 224/195
2015/0021372 A1 * 1/2015 Moreau ..... A45F 5/021 224/677
2017/0245624 A1 * 8/2017 Neves ..... A45C 11/00
2020/0216224 A1 * 7/2020 Nichols ..... B65D 51/28
2021/0373499 A1 * 12/2021 Blume ..... A41F 1/002
2022/0031037 A1 * 2/2022 Bourquin ..... A45C 7/0045

* cited by examiner

*Primary Examiner* — Brian D Nash
(74) *Attorney, Agent, or Firm* — Harrison Law Office, P.C.

(57) ABSTRACT

A portable, wearable apparatus for emplacing and securely gripping an electrolyte gel pack enabling a runner to expeditiously access the gel pack in situ to consume the electrolyte without interrupting running performance. Gel-pack carrier runner-athlete's apparatus attached to a runner's shirt or shorts by a suitable clip or clamping or belt-like mechanism. Embodiments may be molded, forged, pressed plastic, and/or manufactured via 3-D printing and comprises a pair of side-panels with an intermediate center-panel, an interior retaining assembly to promote a gel pack being securely held in situ while a runner or athlete participates in a vigorous activity, and an attachment assembly for releasably attaching the apparatus to fabric, webbing or belting material. The retaining assembly comprises a retention member configured with and secured by holding teeth for retaining an electrolyte pack and including tearing teeth for releasing the pack to initiate hydrating fluid flow.

5 Claims, 4 Drawing Sheets

(30A)
(30B)
(50)
(10B)
(10A)
(60)
(20)
(80)
(70)
(40)

RUN RIPPER RUNNER'S APPARATUS

CROSS-REFERENCE TO RELATED APPLICATIONS

Not applicable.

STATEMENT REGARDING FEDERALLY SPONSORED RESEARCH OR DEVELOPMENT (IF APPLICABLE)

Not Applicable.

REFERENCE TO SEQUENCE LISTING, A TABLE, OR A COMPUTER PROGRAM LISTING COMPACT DISC APPENDIX (IF APPLICABLE)

Not Applicable.

BACKGROUND OF THE INVENTION

Athletes and especially runners will readily appreciate the importance of sustaining adequate hydration during training activity and athletic competition. It has of course become apparent to runners having a variety of experience and prowess of the profound interrelationship between conditioning and nutritional balance and athletic performance. Contrariwise, runners suffering from a deficiency of regularly consuming sufficient fluid electrolyte to sustain adequate dehydration. The diverse nature of specific athletic competitions has led to diverse ways in which hydrating fluids are made available to and consumed by the athletes participating in these competitions.

Accordingly, for athletes to achieve peak performance or at least to avoid suffering from health issues and jeopardizing well-being, it's imperative to take precautions during training exercises preparatory to and actually participating in competitive running and like activities, to avail themselves of regular and routine hydration protocols as a function of differing training and competition circumstances including weather and related environmental conditions. As is well known by practitioners in the art, many attempts have been made io achieve these crucial hydration goals for the benefit and well-being of athletes, but with only limited success.

Athletes and especially runners will readily appreciate the importance of sustaining adequate hydration in situ during training activity and athletic competition. It has of course become apparent to runners having a variety of experience and concomitant prowess of the profound interrelationship between conditioning and nutritional balance and athletic performance. Contrariwise, runners suffering from a deficiency of regularly consuming sufficient fluid electrolyte to sustain adequate dehydration. The diverse nature of specific athletic competitions has led to diverse ways in which hydrating fluids are made available to and consumed by the athletes participating in these competitions.

Accordingly, for athletes to achieve peak performance or at least to avoid suffering from health issues and jeopardizing well-being, it's imperative to take precautions during training exercises preparatory to and actually participating in competitive running and like activities. Insodoing, Athletes should be encouraged to avail themselves of regular and routine hydration protocols as a function of differing training and competition circumstances including weather and related environmental conditions. Many attempts have been made in the art to achieve these crucial goals but with only limited success.

For instance, in U.S. Pat. No. 10,285,523 Pugsley discloses a hydration apparatus for enabling an athlete to hydrate in situ with liquids while competing-without adversely affecting her pace or stride performance. The Pugsley hydration assembly includes a neck cord extended below an athlete's mouth for enabling insertion of a straw's distal end into her mouth and simultaneous insertion of the straw's other opposite proximal end into an open-top cup holding hydrating liquid. While running at her preferred pace, the runner is effectively hydrated by consuming liquid through a straw rather than by inefficiently attempting to consume liquid directly from an open-top cup. This apparatus is comprised of a lightweight hydration assembly and an interrelated lightweight attachment assembly configured to be worn by an athlete during race competition and inherently facilitating her in situ hydration absent any discomfort or distraction. When arriving at a hydrating station, a runner would be wearing a neck cord component of this hydration assembly extending below her mouth thereby enabling her to insert the proximal straw-end into her mouth, while inserting the distal straw-end into the open-top fluid-filled cup. Interestingly, alternative embodiments of this dual hydration assembly could be attached to an armband or other wearable item.

Another example is illustrated by Lynch et al., in U.S. Pat. No. 9,926,123, disclosing a bicep hydration sleeve configured for enabling an athlete to circumscribe the sleeve for being secured to her bicep for easily lifting the sleeve to her mouth while moving her bicep toward her chin. Then she would insert an attached mouthpiece into her mouth for appropriately hydrating herself handsfree during athletic activities. This sleeve is Comprised of a flexible bladder housing configured to accommodating about 12 ounces of fluid and accompanied by a plurality of straps for securing attachment thereof; this sleeve apparatus includes a mouthpiece aperture dimensioned to pass a mouthpiece therethrough.

Still another attempt in the art is disclosed in U.S. Pat. No. 9,212,067, wherein Gellibolian et al., teach a storage and dispensing protocol configured for delivering sufficient hydrating electrolyte using a flow meter enabling extent of hydration to be monitored in real-time-relying on a hydrating modular fluid container having a combination of an assembly for filtering impurities and UV purification source for emitting germicidal UV light.

O'Connell, in U.S. Pat. No. 8,397,962, teaches a methodology for an athlete using a handheld drinking cup having an internal compressible bladder for enabling hydrating liquid to flow into the bladder via an inlet valve, and then enabling the hydrating liquid to flow from the bladder through an outlet valve into the athlete's dinking cup. The athlete can expeditiously draw water from a dispensing water stop into her replenishable drinking vessel through its inlet valve to consume hydrating water as needed. This vessel could be configured with a pocket for retaining a gel packet affording an athlete electrolyte to assure adequate hydration.

In view of these developments in the art, notwithstanding ongoing hydration deficiencies available to runners and other athletes, the present invention teaches both a convenient, unobtrusive and an expeditious apparatus enabling a runner to achieve adequate hydration during training exercises or competitions-without adversely affecting performance due to interruptions due to hydration pauses and/or hydration stops and the like. Thus, embodiments of the present invention tend to assure optimal athletic performance attributable to runners' routinely achieving adequate in situ hydration.

BRIEF SUMMARY OF THE INVENTION

The present invention teaches a gel-pack carrier runner-athlete's apparatus—contemplated to be attached to a runner's shirt or shorts or like garment by a suitable clip or clamping or belt-like mechanism. Embodiments of this contemplated runner's apparatus may be molded, forged, pressed plastic, and/or manufactured via 3-D printing.

Embodiments of the present invention comprise a Run Ripper apparatus comprising a pair of side-panels with an intermediate center-panel, an interior retaining assembly to promote a gel pack or like accessory being securely held in situ while a runner or athlete participates in a vigorous activity, and an attachment assembly for conveniently and releasably attaching the Run Ripper apparatus to fabric, webbing or belting material or even a Molle panel worn by a runner-athlete. The retaining assembly comprises a retention member configured with and secured by holding teeth for retaining an electrolyte pack and including tearing teeth for releasing the pack to initiate hydrating fluid flow thereby enabling a runner to conveniently and expeditiously imbibe its contents without interrupting running progress. The attachment assembly can be configured with a variety of pouches or pockets for conveniently carrying and accessing not only electrolyte packets, but also other accessories useful in situ to runners and like athletes during training routines and competitive events.

As will be hereinafter elucidated, the Run Ripper apparatus is configured with a specially contoured retaining assembly having a pair of proximate similarly angled wedge members for cooperatively affording sufficient tension to securely retain the electrolyte pack therein and to use its loading lever to ease the tension wherein the electrolyte pack would be released and its electrolyte contents would be imbibed in situ while the runner continues to uninterruptedly participate in training exercise or running competition.

It is an object and advantage of embodiments of the present invention to provide a convenient, inexpensive and portable apparatus for securely enclosing an electrolyte pack in an apparatus suitable to be attached and effectively locked onto a runner's garment and then to be readily removed therefrom enabling the electrolyte to be imbibed in situ without interrupting and undermining the runner's performance.

It is another object of the present invention to provide a runner's accessory easily attachable to a garment and for securing retaining and readily accessing an electrolyte pack in situ during training and while participating in running competition for enabling the runner to imbibe the electrolyte liquid without interrupting running progress or pace thereof.

These and other objects and advantages of the present invention will become apparent from the following specification and accompanying drawings.

DETAILED DESCRIPTION OF THE INVENTION

Reference is made herein to the figures in the accompanying drawings wherein like numerals refer to like components. Referring collectively to FIGS. 1-4, depicted therein are various views of the preferred "Run Ripper" portable apparatus embodying the present invention.

Figure 1:
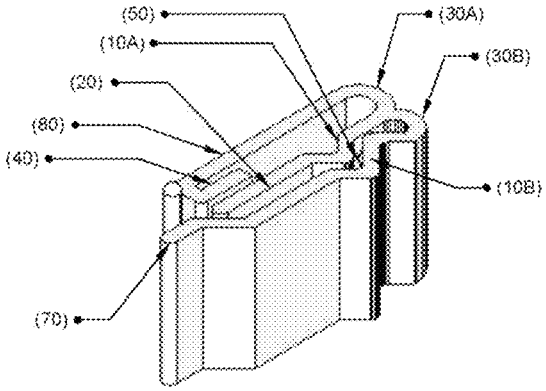
FIG. 1 depicts a frontal perspective view of a running accessory embodiment of the present invention.
Figure 2:
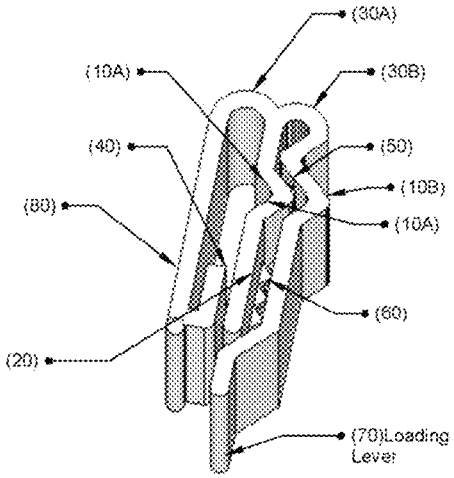
FIG. 2 depicts a top perspective view of a running accessory embodiment of the present invention depicted in FIG. 1.

As will be elucidated herein, FIGS. 1 and 2 depict perspective views of an embodiment of the instant portable running accessory embodiment of the present invention. Top and bottom views thereof are depicted in FIGS. 3 and 4, respectively.

Now referring specifically to FIGS. 1 and 2, there are depicted two respective isometric drawings correspond to each of frontal and planar perspective views of portable apparatus 2 comprising first side-panel and second side-panel 6, with center-panel 20 disposed medially of said first side-panel 5 and said second side-panel 6. More particularly, first side-panel 5 is disposed upon first side of portable apparatus 2 and second side-panel 6 is similarly disposed upon second side 4 thereof. Center-panel 20, as shown, is disposed laterally between first side and second side of portable apparatus 2—configured with retaining assembly 15 to promote a gel pack or like running accessory being securely held in situ while a runner or athlete participates in vigorous activity. Accordingly, retaining assembly 15 comprises retention member 55 with interior wall 6A of side-panel 6 having plurality of holding teeth 50 and plurality of tearing teeth 60, respectively, affixed thereupon; and wedge member 11A protruding outwardly therefrom proximal to similarly configured another wedge member 11B of said other side-panel 5B.

As will be hereinafter elucidated, the angles of respective wedge members 11A-B of tension wedge pair 10 are substantially identical, i.e., preferably angled at approximately 90° for affording sufficient tension to promote a gel pack (not shown) or like packaged electrolyte-imparting viscous substance being retained by retention member 55 while an athlete is participating in training or competitive running or other vigorous activity.

Figure 3:
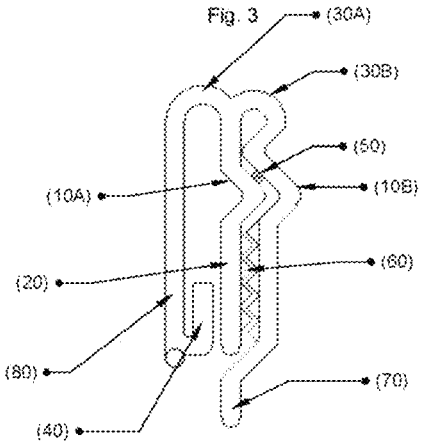
FIG. 3 depicts a top view of a running accessory embodiment of the present invention depicted in FIGS. 1 and 2.
Figure 4:
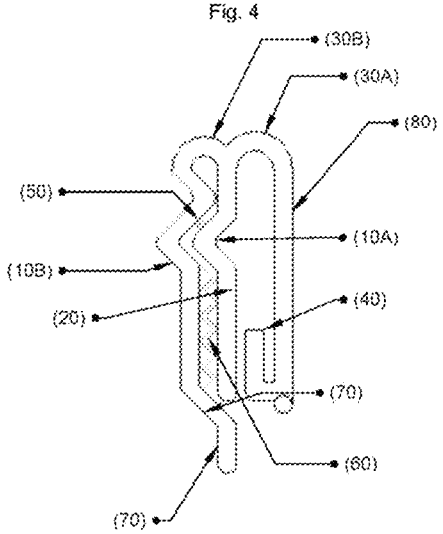
FIG. 4 depicts a reversed bottom view of a running accessory embodiment of the present invention depictedin FIG. 3.

Still referring to FIGS. 3 and 4, first loop or first shoulder member 30A is seen fixedly adjoined to paired similar second loop or second shoulder member 30B structured contiguously, thereby enabling simultaneous gradual partial manual opening thereof via single loading lever member 70. As will be appreciated by those skilled in the art when loading lever 70 is manually maneuvered counterclockwise, tension inherently manifest by presence of retaining assembly 15 and belt loop 80 being attenuated thereby allowing a gel pack or like electrolyte-releasing accessory and a belt or like fabric member to be securely inserted therein, respectively.

It should be understand once loading lever 70 is released, i.e., returned to its neutral position tending to assert pressure on contiguously situated side-panel 6, center panel 20 and other side panel 5—all intertwined through said contiguous shoulder pair first shoulder member 30A and second shoulder member 30B—the electrolyte gel pack is urged to remain in situ reinforced by being firmly gripped with adjacent plurality of holding teeth 50 in conjunction with its proximity to plurality of ripping teeth 65 of ripping member 60. It will be appreciated holding teeth 50 and tearing teeth 60, in conjunction with mated wedge members 11A-11B afford a unique synergistic relationship effectuating a locking mechanism for securing the electrolyte gel pack or the like.

Hence, when an active athlete needs to benefit from a supplemental source of energy such as energy imparted via electrolyte present on the Run Ripper apparatus, without interrupting the activity in progress and consequently without undermining the athlete's performance, the athlete would rotate the retained gel pack perpendicularly and simultaneously would compress belt loop 80 along with attached center panel 20 and angled loading lever 70 clockwise, thereby squeezing tearing teeth 60 to assert force against tearing teeth 60 and pulling this opened and relaxed retention assembly 15 outwardly. It will be appreciated such procedure facilitates the athlete now being able to easily tear off the gel pack's top portion notwithstanding the hands possibly being gloved or fraught with perspiration or otherwise being compromised by attributes commonly associated with vigorous athletic activity.

The following is a tabulation of the components depicted in the drawing figures:

Component Listing

| NUMERAL | COMPONENT | EXPLANATION |
|---|---|---|
| 2 | "Run Ripper" | portable apparatus |
| 3A | First Side of Portable Apparatus | |
| 3B | Second Side of Portable Apparatus | Disposed Oppositely of First Side |
| 5 | First Side-Panel | exterior wall of a side panel delimiting exterior planar side of apparatus and forming elliptical cavity 85 delimited by opposite internal wall thereof |
| 6 | Second Side-Panel | Contoured surface delimiting side exterior of Retention Assembly 15 |
| 6A | Internal wall of Second Side-Panel 6 | Configured with holding teeth (50) and tearing teeth (60) disposed respectively on opposite internal walls thereof |
| 10 | Tension Wedge Pair | Angled wedges effectuating tension constraining gel pack in situ |
| 11A | First Wedge member | Protruding outwardly angulated from Center Panel; retaining gel pack in position |
| 11B | Second Wedge member | Protruding outwardly angulated from Second Side Panel; Retaining gel pack in position |
| 15 | Retention Assembly | For retaining electrolyte gel pack or other electrolyte-imparting accessory |
| 20 | Center Panel | |
| 22 | First wall | Disposed on one side of Center Panel 20 |
| 24 | Second wall | Disposed on other side of Center Panel 20 |
| 30A | Loop or shoulder for supporting gel pack | Affording tension urging retention of gel pack within retention member 55 |
| 30B | Loop or shoulder for supporting fabric belt | Tension tends to urge retention of fabric belt within belt loop 80 |
| 40 | Belt Hook | promote retaining belt within belt loop 80 |
| 50 | Holding member | Having Plurality of Teeth for firmly gripping gel pack while in situ |
| 53 | Plurality of Teeth of Holding Member 50 | |
| 55 | Retention member | Contoured cavity for retaining gel pack therewithin |

-continued

| NUMERAL | COMPONENT | EXPLANATION |
|---|---|---|
| 60 | Ripping Member | Having Plurality of Teeth for frictionally tearing open gel packet when manually urged by wearer |
| 65A-C | Plurality of Teeth of Ripping Member 60 | |
| 70 | Lever member, angled | Maneuverable for flexibly loading gel packet and securing gel packet therein |
| 80 | Belt Loop member | Circumscribing and defining a rectangular cavity for accommodating a variety of lightweight fabrics, e.g., webbing suitable for serving as an effective means for attaching an embodiment of the instant apparatus to a runner's or other athlete's garment |

Other variations and modifications will, of course, become apparent from a consideration of the structures and techniques hereinbefore described and depicted. Accordingly, it should be understood the present invention is not intended to be limited by the particular features and structures hereinbefore described and depicted in accompanying drawings, but the present invention is to be measured by the scope of the appended claims.

What is claimed is:

1. A portable apparatus for carrying a plurality of running accessories comprising:

a first side-panel disposed on a first side of said portable apparatus;

a second side-panel disposed on a second side of said portable apparatus while also disposed on an opposite lateral side of said first side of said portable apparatus;

a center panel disposed medially of said first side-panel and said second side-panel, and contiguously adjoined with said first side-panel by a first rounded shoulder member disposed at one end thereof, while also being adjoined with said second side-panel by a second rounded shoulder member disposed contiguously with said first rounded shoulder member;

a retaining assembly formed between said center-panel and said second side-panel comprising a retention member for securing an enclosed electrolyte pack or like running accessory therein urged by an outwardly protruding first wedge member and a correspondingly configured mated second wedge member; and an attachment assembly formed between said center-panel and said first side-panel for releasably and securably attaching said portable apparatus to a runner's garment including fabric, webbing or belt material.

2. The portable apparatus recited in claim 1, wherein said retaining assembly further comprises a pair of shoulder members, a plurality of holding teeth and a plurality of tearing teeth.

3. The running apparatus recited in claim 2, wherein said plurality of holding teeth and said plurality of tearing teeth are fixedly attached to a common interior surface of said center panel.

4. The running apparatus recited in claim 3, wherein said plurality of holding teeth is disposed above said mated wedge members.

5. The running apparatus recited in claim 3, wherein said plurality of tearing teeth is disposed below said mated wedge members.

* * * * *